US005255865A

United States Patent [19]

Buell et al.

[11] Patent Number: 5,255,865

[45] Date of Patent: Oct. 26, 1993

[54] CORES PROVIDING REDUCED SPINDLE CLEARANCE FOR CORE WOUND PAPER PRODUCTS

[75] Inventors: Kenneth B. Buell; Donald D. Dearwester, both of Cincinnati, Ohio

[73] Assignee: The Procter & Gamble Company, Cincinnati, Ohio

[21] Appl. No.: 986,955

[22] Filed: Dec. 8, 1992

[51] Int. Cl.[5] ..... B65H 16/02

[52] U.S. Cl. ..... 242/68.5; 206/389

[58] Field of Search ..... 242/68.5, 55.2, 55.53; 206/389, 410, 411; 493/960

[56] References Cited

U.S. PATENT DOCUMENTS

| | | | |
|---|---|---|---|
| 347,416 | 8/1886 | Buckingham | 229/93 X |
| 401,233 | 4/1889 | Wheeler | 242/68.5 X |
| 972,668 | 10/1910 | Wheeler | 242/68.5 |
| 1,005,787 | 10/1911 | Sibley | 242/68.5 |
| 2,571,321 | 10/1951 | Wettley | 242/55.2 |
| 2,639,099 | 5/1953 | Gough, Jr. | 242/55.2 |
| 2,659,543 | 11/1953 | Guyer | 242/72 |
| 2,889,121 | 6/1959 | Heinle | 242/55.2 |
| 3,082,931 | 3/1963 | Greenwell et al. | 229/37 |
| 3,145,940 | 8/1964 | Henry | 242/55.2 |
| 3,170,652 | 2/1965 | Kennedy | 242/55.2 |
| 3,224,700 | 12/1965 | Heinle | 242/55.53 |
| 3,258,216 | 6/1966 | Wren | 242/55.53 |
| 3,433,355 | 3/1969 | Smith | 206/59 |
| 3,601,328 | 8/1971 | McClung | 242/55.2 |
| 3,630,430 | 12/1971 | Struble | 229/16 B |
| 4,120,323 | 10/1978 | Saul | 138/129 |
| 4,660,781 | 4/1987 | Hazard | 242/55.2 |
| 4,762,061 | 8/1988 | Watanabe et al. | 100/35 |
| 4,886,167 | 12/1989 | Dearwester | 206/389 |
| 4,907,696 | 3/1990 | DeCoste, Jr. | 206/411 |
| 4,909,388 | 3/1990 | Watanabe | 206/410 |
| 5,027,582 | 7/1991 | Dearwester | 53/399 |

FOREIGN PATENT DOCUMENTS

| | | | |
|---|---|---|---|
| WO92/11196 | 7/1992 | PCT Int'l Appl. . | |
| 709363 | 5/1954 | United Kingdom . | |
| 1593250 | 7/1981 | United Kingdom | 242/68.5 |

*Primary Examiner*—Daniel P. Stodola
*Assistant Examiner*—John Rollins
*Attorney, Agent, or Firm*—Gerry S. Gressel; Larry L. Huston; Fredrick H. Braun

[57] ABSTRACT

A core for compressed core wound paper products adapted for rotation on a spindle. The core is deformable from a generally rounded configuration to a generally flattened configuration for transportation and storage. The core includes tab portions that are deformable to extend radially inward of core inner and outer surfaces to reduce core to spindle clearance when the core is rounded for use.

16 Claims, 5 Drawing Sheets

CORES PROVIDING REDUCED SPINDLE CLEARANCE FOR CORE WOUND PAPER PRODUCTS

CROSS REFERENCE TO RELATED APPLICATION

This patent application cross-references and incorporates by reference the following patent application assigned to The Procter and Gamble Company and filed herewith: U.S. patent application Ser. No. 07/986,645 entitled Improved Cores for Core Wound Paper Products, filed on Dec. 8, 1992 by Jay K. Sato.

FIELD OF THE INVENTION

This invention is related to cores for core wound paper products, and particularly to cores having a generally flattened configuration prior to use, and a rerounded configuration during use.

BACKGROUND OF THE INVENTION

Rolls of toilet paper and paper toweling typically comprise a paper product wound upon a hollow core. The roll is typically supported for rotation on a spindle which extends through the hollow core.

A typical core shape for dispensing a paper product is a cylinder having a geometrically circular cross-section. A core with a circular cross-section freely rotates about the axis of the spindle and permits smooth dispensing of the paper product from the roll. However, a core having a hollow circular cross-section has a relatively large void space. It is desirable to reduce such void spaces to improve shipping and storage efficiencies.

One improvement to core wound paper products includes diametric compression of the roll, such that the core has a generally flattened configuration with reduced core void space. The flattened core configuration permits the core wound product to be shipped and stored more economically and in higher densities.

Several attempts have been made in the art to realize the benefits of compressed core wound paper products. Examples of compressed core wound paper products are disclosed in the following references: U.S. Pat. 401,233 issued Apr. 9, 1889, to Wheeler, U.S. Pat. 972,668 issued Oct. 11, 1910, to Wheeler; U.S. Pat. No. 1,005,787 issued Oct. 10, 1911, to Sibley; U.S. Pat. No. 4,762,061 issued Aug. 9, 1988, to Watanabe, U.S. Pat. No. 4,886,167 issued Dec. 12, 1989, to Dearwester, U.S. Pat. No. 4,909,388 issued Mar. 20, 1990, to Watanabe, U.S. Pat. No. 5,027,582 issued Jul. 2, 1991 to Dearwester; PCT International Publication Number WO 92/11196 Published Jul. 9, 1992, by Dearwester et al.; and G.B. Patent 709,363 issued May 19, 1954, to Samson.

While the compressed rolls taught in these references reduce hollow core void space, they do not provide preferred dispensing characteristics. Previously compressed or flattened cores, when rerounded, typically have a non-circular cross-section. Flattening of the core for compression creates generally flattened core sections connected at folding creases or vertices. The rerounded core will have an oblong or polygonal cross-section having a relatively flat side corresponding to each folding crease or vertex. Such a core cross-section is characterized by nonuniform radial clearances between the core and spindle at different circumferential positions on the core. These differences in radial clearance result in wobble and noise as the roll is rotated on the spindle to dispense the paper product.

Accordingly, it is an object of the present invention to provide a core which has a generally flattened configuration and a generally rerounded configuration. Another object of the present invention is to provide a core having a means for reducing the clearance between the core and the spindle when the core is in the generally rerounded configuration. Yet another object of the present invention is to provide a core having a portion that can be deformed to extend radially inwardly to reduce core to spindle clearance when the core is in the generally rerounded configuration. Yet another object of the present invention is to provide a core having a portion that can be deformed to extend radially inward to engage a spindle, so that the spindle and core rotate together during dispensing of a paper product.

BRIEF SUMMARY OF THE INVENTION

The present invention comprises a core about which a paper product may be wound. The core is adapted to be rotatably supported on a spindle, and is deformable from a generally flattened configuration to a generally rerounded configuration.

The core has inner and outer surfaces separated by a core wall thickness, and first and second longitudinally spaced apart core ends defining a longitudinal core axis and a core length. Additionally, the core can have one or more tab portions at a given circumferential or longitudinal position.

Each tab portion is deformable to extend radially inward of the core surfaces when the core is in the generally rerounded configuration. Each tab portion includes at least one panel extending longitudinally and circumferentially and having a selectively weakened panel attachment to the core.

In one embodiment, each tab portion can have longitudinally spaced apart first and second tab portion free edges formed by cuts extending through the core wall thickness. The first and second longitudinally extending selectively weakened panel attachments to the core can join first and second tab portion panels to the core. The first and second tab portion panels can be pivotably connected at a folding hinge extending intermediate the first and second tab portion free edges.

In a second embodiment, each tab portion can have at least one longitudinally and circumferentially extending panel having first and second biconvex selectively weakened panel attachments to the core. Each tab portion can have a folding hinge extending intermediate the first and second tab portion ends. The first and second biconvex selectively weakened panel attachments to the core can comprise circular arcs.

BRIEF DESCRIPTION OF THE DRAWINGS

While the Specification concludes with claims particularly pointing out and distinctly claiming the present invention, it is believed the invention will be better understood from the following Specification taken in conjunction with the associated drawings wherein like parts are given the same reference numeral, and:

DETAILED DESCRIPTION OF THE INVENTION

Figure 1:
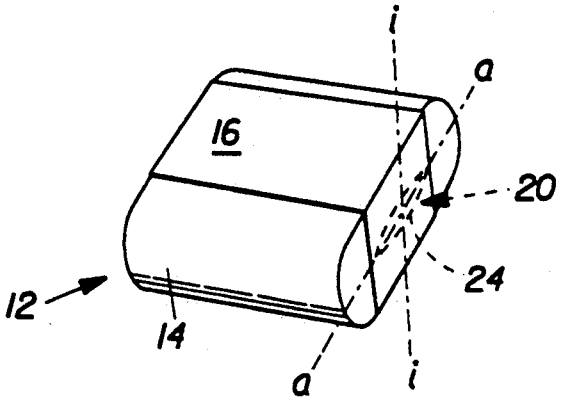
FIG. 1 is a perspective view of a flattened roll having a generally flattened core.

FIG. 1 illustrates a generally flattened roll 12 having a generally flattened core 20. A "core" as used herein refers to a hollow tubular member upon which a paper product 14 can be wound in a spiral fashion for later dispensing. "Paper product" as used herein refers to a base product, preferably cellulosic, wound onto core 20, and can include but not be limited to facial or toilet tissue, or paper toweling. A "roll" as used herein refers to the combination of the core 20 and the paper product 14 wound on the core 20.

The core 20 can be flattened along a flattening axis a—a by a pair of compressive forces directed along an axis i—i perpendicular to axis a—a. The roll 12 can include a wrapping 16 to maintain the roll 12 in the generally flattened configuration illustrated in FIG. 1 until the roll 12 is ready for use.

Figure 7:
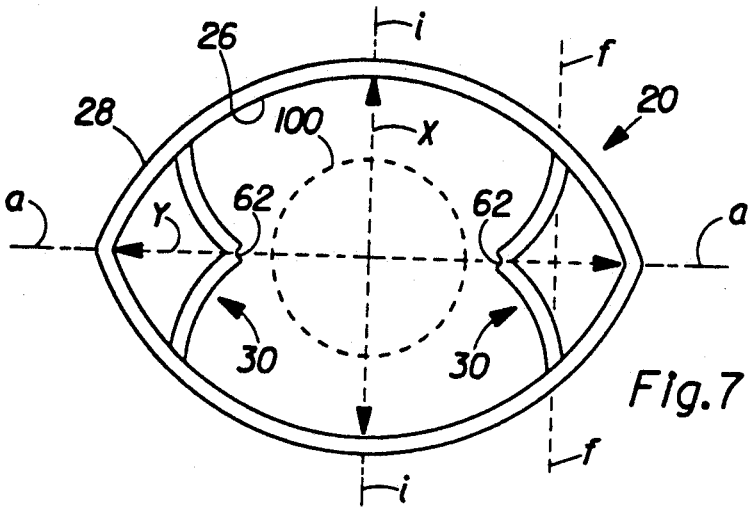
FIG. 7 is an end view of a core having a core with a rerounded configuration which is not cylindrical.

Prior to use, the consumer rerounds the flattened roll 12 so that a spindle can be inserted into the hollow core 20. Referring to FIG. 7, by a "rerounded" core 20 it is meant that the core 20 has an inside radial dimension Y along the flattening axis a—a which is no more than 5.0 times the inside radial dimension X along the axis i—i and preferably no more than 3.0 times the dimension X.

During use roll 12 is typically supported on a spindle 100 (shown in phantom in FIG. 5) for dispensing of the paper product 14. The spindle 100 extends through the hollow core 20 and rotatably supports the roll 12.

Figure 5:
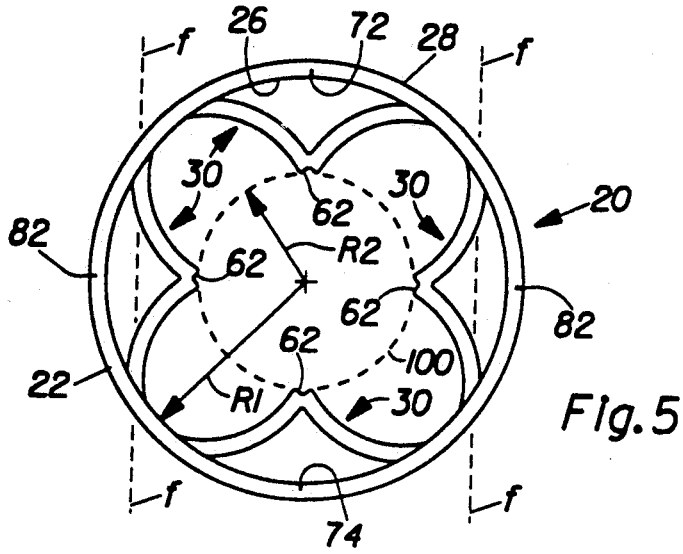
FIG. 5 is an end view of a generally rerounded core having four tab portions extending radially inward from the core inner and outer surfaces to engage a spindle.
Figure 6:
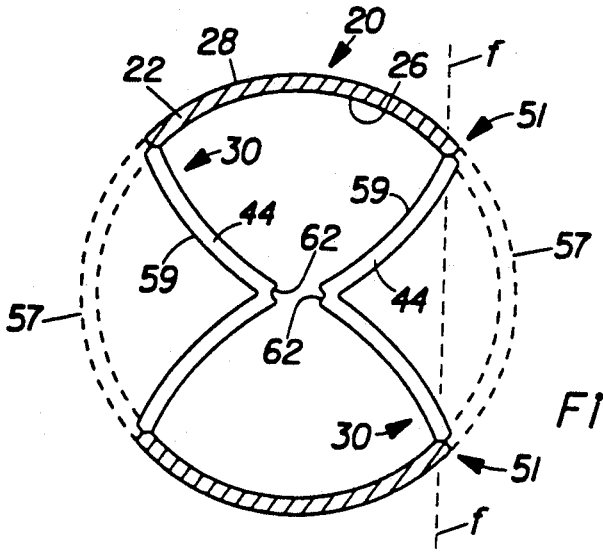
FIG. 6 is an instant sectional view taken along lines 6—6 of FIG. 2 illustrating a first stable tab portion configuration wherein two tab portions are deformed to extend radially inward from the core inner and outer surfaces, and illustrating a second stable tab portion configuration shown in phantom, wherein the two tab portions are unfolded to conform to the core inner and outer surfaces.

It is desirable that the rerounded hollow core 20 have a cross-section which provides quiet dispensing as illustrated in FIGS. 5–7. In contrast, a prior art rerounded core 20 can have an oblong or polygonal cross-section which provides circumferentially non-uniform radial clearance between the core 20 and spindle 100. Such prior art cores 20 produce a thumping noise and uneven dispensing when rotated on a conventional cylindrical spindle 100.

Figure 2:
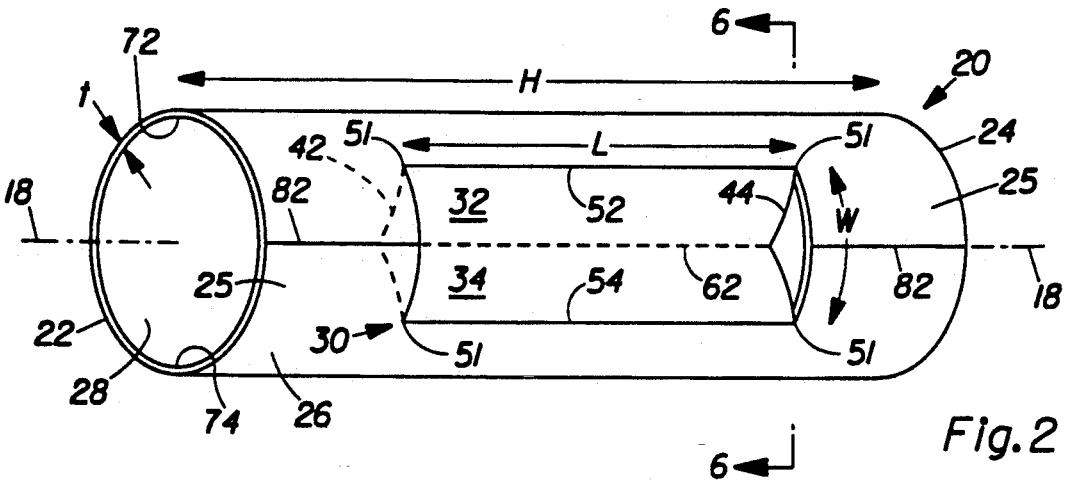
FIG. 2 is a perspective view of a core in a generally rerounded configuration according to one embodiment of the present invention, wherein the core has a tab portion with free edges, the tab portion extending radially inward from the core inner and outer surfaces.

As illustrated in FIG. 2, the core 20 according to the claimed invention has a longitudinal length H and a core axis 18 defined by the centers of two oppositely disposed, longitudinally spaced apart core ends 22 and 24. The core 20 has an outer surface 26 with an outer circumference and an inner surface 28 with an inner circumference, the outer and inner surfaces 26 and 28 being separated by a core wall thickness t. In a first embodiment, the core 20 can include at least one tab portion 30 having selectively weakened attachments 52 and 54 to the core 20. Each tab portion 30 can have free edges 42 and 44 and be circumferentially aligned with one or more core side panels 25. In a second embodiment, the core 20 can include at least one tab portion 130 having biconvex curvilinear selectively weakened attachments 152 and 154 to the core 20. The core 20 according to the first embodiment of the present invention is shown in FIGS. 2 through 9. The core 20 according to the second embodiment of the present invention is shown in FIGS. 10 through 13.

When the paper product 14 is wound on core 20, the resulting roll 12 of the paper product 14 typically has a diameter of about 10.2 cm to 12.7 cm (4.0 to 5.0 in.) and a length H of about 11.4 cm (4.5 in.). The core 20 may be made of a variety of materials including but not limited to paper, plastics, rubbers, or composite laminates.

The core 20 should have a mullen strength of at least 60 and preferably at least 70 as measured according to ASTM Test Method D2529. The core 20 preferably has a thickness t of at least about 0.5 mm in.). A core 20 made of paper can be made of two spirally wrapped plies of a paper having any suitable combination of bleached krafts, sulfites, hardwoods, softwoods, and recycled fibers. Preferably, the paper is not calendered, so that it is relatively stiff and retains adhesive deposited thereon.

The core 20 may be made of paper having a basis weight of about 0.16 kg/square meter (0.032 lb/sq. ft.) and a ring crush strength of at least 6.79 kg/cm (38 lb/in.) and preferably at least 8.93 kg/cm (50 lb/in.) as measured according to TAPPI Standard T818 OM-87.

Regardless of the material used to make the core 20, the core 20 should have a longitudinal Taber stiffness of at least 40 Taber Stiffness Units (gram-centimeters) and preferably at least 75 Taber Stiffness Units (gram-centimeters) as measured with a stiffness tester according to TAPPI Standard T489 OM-86, with the following equipment and test procedure. A Teledyne Taber V-5 Stiffness Tester, Model 150-B can be used, such as is commercially available from Testing Machines Inc., Amityville, N.Y. Test samples are cut from a core 20 to have a sample length of 6.985 centimeters (2.75 inches) as measured along the longitudinal axis of the core 20 and a sample width of 3.81 centimeters (1.5 inches) as measured around the circumference of the core 20. The core 20 should be free of wrinkles, tears, or creases. The curvature of the samples cut from the core 20 should be reduced prior to testing so that when the sample is placed on a flat surface, the sample has an arc extending no more than about 0.159 centimeters (0.0625 inches) above the flat surface. The curvature of the sample can be reduced by holding a straight edge along the length of the sample and gently applying a force along the length of the sample to reverse the curvature of the sample. The procedures can be repeated at spaced apart intervals of between about 0.32 centimeter and 0.64 centimeter across the width of the sample. The reduced curvature samples are then clamped widthwise in the stiffness tester so that the stiffness along the length dimension of the sample is measured. The Model 150-B stiffness tester is set to a test range of 50–500, with a test length of 5 centimeters, rollers mounted down, and a range weight of 500 units. TAPPI Standard T489 OM-86 states that sample stiffness should be measured in both a machine direction and cross-machine direction. The range of stiffness listed above refers only to stiffness measured along the length dimension of the sample.

Figure 8:
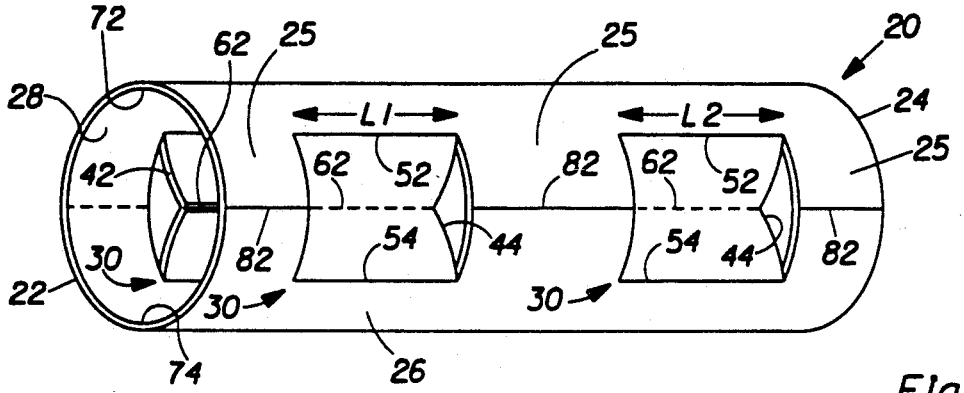
FIG. 8 is a perspective view of a core having two longitudinally spaced apart tab portions at a given core circumferential position.
Figure 9:
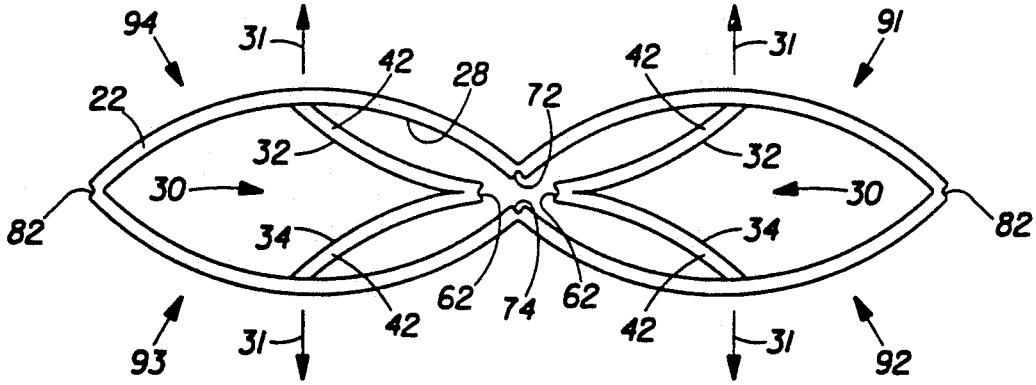
FIG. 9 is an end view of a core according to the present invention where the core is in a generally flattened configuration and the tab portions are folded radially inward.

Referring to the first embodiment of the core 20 shown in the FIGS. 2 through 9, the core 20 is selectively weakened by a series of cuts and perforations, score lines, or creases that permit the core 20 to be compressed to a generally flattened configuration shown in FIG. 9, and rerounded as shown in FIGS. 2 through 8. The series of cuts and perforations, score lines, or creases also provide one or more tab portions 30. The tab portions 30 are deformable to extend radially inwardly when the core 20 is in the generally rerounded configuration, and thereby reduce the radial clearance between the spindle 100 and the core 20.

As used herein, a "cut" refers to removal or severance of core 20 material which removal or severance extends through the core 20 wall thickness t. As used herein, a "crease" includes a continuous line of compression or densification of the wall of the core 20, a hinge formed by the geometry of the wall of the core 20, or a line of folding of the wall of the core 20. As used herein, "score line" refers to a continuous line defined by material removed, partially severed, or absent from one of the surfaces 26, 28 of the core 20. A score line can penetrate between 25 percent to about 75 percent or more of the core wall thickness t. For instance, a score line can extend through one ply of a two ply core 20. As used herein, "perforations" refers to a discontinuous series of discrete cuts, holes, or short score lines, where adjacent cuts, holes, or short score lines are spaced apart by lands having at least a fraction of the full core 20 wall thickness t. For instance, a line of perforations can include cuts approximately one millimeter in length spaced apart by lands approximately one millimeter in length.

Figure 3:
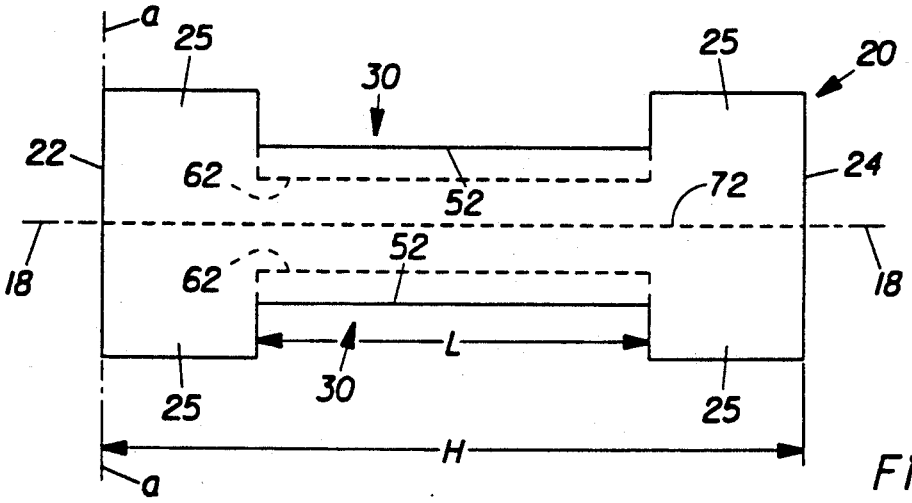
FIG. 3 is a top view of the core of FIG. 2 illustrating two diametrically opposed tab portions.
Figure 4:
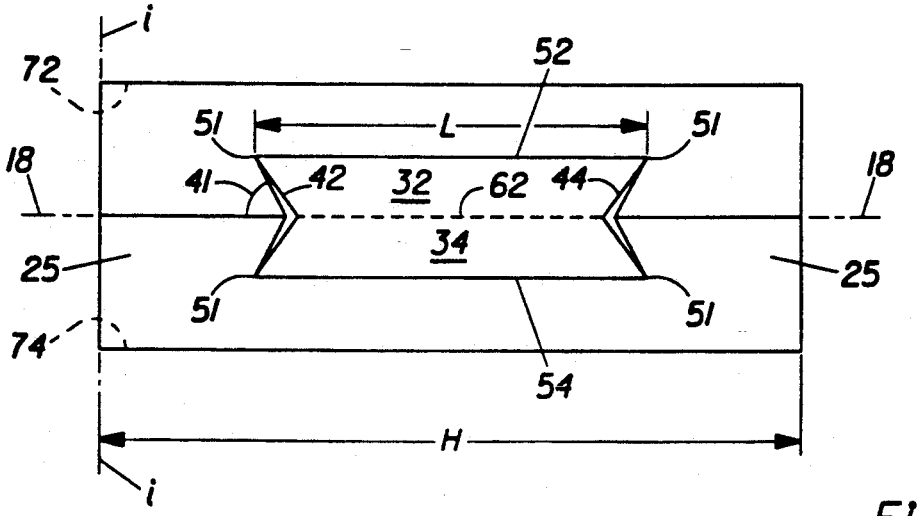
FIG. 4 is a side view of a core similar to that of FIG. 2, but with a tab portion having concave free edges.

The core 20 according to the present invention is provided with at least one tab portion 30 which deflects relative to core side panels 25. FIGS. 2–4 illustrate a core 20 having one tab portion 30 at a given circumferential position, and FIG. 8 illustrates a core 20 having two longitudinally spaced apart tab portions 30 at a given circumferential position on the core 20 circumference. The tab portions 30 are deformed to extend radially inward of the core outer and inner surfaces 26 and 28 when the core 20 is in a generally rerounded configuration, as shown in FIGS. 2 through 8. By "deformed to extend radially inward from the core surfaces 26 and 28", it is meant that at least a portion of the tab portion 30 is disposed between the center of the core 20 and an imaginary axis f—f extending between two longitudinally aligned ends 51 of selectively weakened attachments 52 and 54 to the core 20.

Referring to FIGS. 5 through 7, the tab portion 30, particularly the folding hinge 62, extends radially inward of the imaginary axis f—f. The tab portions 30 can also fold radially inwardly when the core 20 is in a generally flattened configuration, as shown in FIG. 9.

Each tab portion 30 according to the embodiment shown in FIGS. 2 through 9 has longitudinally spaced apart first and second free edges 42 and 44 which can be formed by cuts extending through the wall thickness t of the core 20. Each tab portion 30 also has first and second selectively weakened panel attachments 52 and 54 to the core 20, as indicated in FIG. 2. The first and second selectively weakened panel attachments 52 and 54 are circumferentially spaced apart, and extend intermediate the first and second free edges 42 and 44 to terminate at ends 51.

A folding hinge 62 can be positioned intermediate the first and second selectively weakened attachments 52 and 54 to extend intermediate the first and second free edges 42, 44. Each tab portion 30 can have two longitudinally and circumferentially extending circular arc panels 32 and 34 pivotably connected by the folding hinge 62.

The core 20 can have at least one pair of substantially diametrically opposed tab portions 30, and a pair of substantially diametrically opposed means 72 and 74 for selectively weakening the core 20 to facilitate flattening of the core 20 as shown in FIG. 9. The means 72 and 74 for selectively weakening the core 20 are spaced substantially 90 degrees from the folding hinges 62 of the tab portions 30, and can comprise a line of perforations, a crease, or a score line such as on the core inner surface 28. The means 72 and 74 for selectively weakening the core 20 can extend between the first and second core ends 22 and 24. A core weakening means 82 can also be circumferentially aligned at or near each folding hinge 62, to facilitate flattening of the core 20 as shown in FIG. 9.

By "substantially diametrically opposed" it is meant that two features are angularly positioned within 170 degrees to 190 degrees of each other, inclusive, and are preferably about 180 degrees apart. By "substantially 90 degrees" it is meant that two features are angularly positioned within 80 degrees to 100 degrees of each other, inclusive, and are preferably about 90 degrees apart.

A plurality of tab portions 30 can be positioned symmetrically about the circumference of core 20. FIG. 5 provides an end view of a core 20 having four tab portions 30 positioned symmetrically about the circumference of core 20, and FIG. 6 provides a cross-sectional view of a core 20 having two substantially diametrically opposed tab portions 30.

FIG. 5 illustrates how radially inward extending tab portions 30 reduce the core 20 to spindle 100 radial clearance. A spindle 100 is shown in phantom in FIG. 5. R1 in FIG. 5 represents the original inside diameter of a core 20 without the benefit of tab portions 30. R2 represents the reduced effective inside diameter of the core 20 when the tab portions 30 are deformed to extend radially inward from the core surfaces 26 and 28. By reducing the effective inside diameter of the core 20, the tab portions 30 reduce the radial clearance between the core 20 and the spindle 100, thereby reducing radial shifting of the roll 12 relative to the spindle 100 during dispensing of the product 14. Reducing such shifting minimizes uneven dispensing and the undesirable dispensing noise characterized by a "thumping" sound.

For a given spindle 100 diameter, the tab portions 30 can be sized to engage the spindle 100, as shown in FIG. 5. Such engagement between the core 20 and the spindle 100 can promote rotation of the core 20 and spindle 100 as a unit, thereby providing smooth, quiet dispensing.

FIG. 6 shows a stable configuration 59 of the tab portion 30 wherein the tab portion 30 is deformed to extend radially inward from the surfaces 26 and 28 of core 20. FIG. 6 also shows, in phantom, a stable configuration 57 of tab portion 30. In the stable configuration 57 the tab portion 30 is unfolded to form a circular arc conforming to the core surfaces 26 and 28. The stable configuration 57 is characterized by a tab portion 30 extending radially outward of the imaginary axis f—f.

The scope of the present invention includes a core 20 having all the tab portions 30 deformed to extend radially inward of the surfaces 26 and 28 of a core 20 when the core 20 is in the generally rerounded configuration. However, the scope of the present invention also includes a core 20 having one or more of the tab portions 30 in the unfolded stable configuration indicated by reference numeral 57, provided there is at least one tab portion 30 deformed to extend radially inward of the imaginary axis f—f when the core 20 is rerounded.

The free edges 42 and 44 of tab portions 30 can be formed by circumferentially oriented cuts extending through the core 20 wall thickness t, and can be longitudinally spaced from the core ends 22 and 24. The free edges 42, 44 are shown extending generally perpendicularly to core axis 18 in FIGS. 2 and 3. Alternatively, the free edges 42 and 44 can be concave towards the ends 22 and 24 of the core 20 as shown in FIG. 4. The concave free edges 42 and 44 can reduce "snagging" or "catching" of the spindle 100 on the free edges 42 and 44 when the spindle 100 is inserted into rerounded core 20. The concave free edges 42 and 44 shown in FIG. 4 can form an angle 41 with the longitudinal axis 18 between 20 degrees and 70 degrees, and preferably form an angle of about 45 degrees.

If the core 20 includes one tab portion 30 at a given circumferential location, the free edges 42 and 44 can be equidistantly spaced from core ends 22 and 24, respectively, so that the tab portion 30 is centered along core longitudinal length H. Alternatively, the free edges 42 and 44 can be coincident with the core ends 22 and 24. If the core 20 includes more than one tab portion 30 at a given circumferential location, the two tab portions 30 nearest the core ends 22 and 24 can have free edges 42 and 44 longitudinally spaced from the core ends 22 and 24, as shown in FIG. 8. Alternatively, if the core 20 includes more than one tab portion 30 at a given circumferential location, the two tab portions 30 nearest the core ends 22 and 24 can have a free edge 42 or 44 coincident with the core end 22 or 24.

Each folding hinge 62 can be formed by selectively weakening the tab portion 30 intermediate the free edges 42 and 44. The folding hinge 62 can comprise a line of perforations extending between the free edges 42 and 44. Alternatively, the folding hinge 62 can comprise a score line, such as a score line on an inner surface of the tab portion 30 extending between the free edges 42 and 44, or a crease extending between free edges 42 and 44. The folding hinge 62 is shown as a dashed line in FIGS. 2 through 8. The core weakening means 82 circumferentially aligned with each folding hinge 62 can comprise a line of perforations, a crease, or a score line, such as a score line on the core outer surface 26.

The selectively weakened panel attachments 52 and 54 can comprise a longitudinally extending weakened line on the core 20, such as a longitudinally extending line of perforations. Alternatively, the panel attachments 52 and 54 can comprise creases, or score lines, such as score lines on the core outer surface 26. The panel attachments 52 and 54 can comprise longitudinally extending straight lines. Alternatively, the panel attachments 52 and 54 could have a curvilinear shape.

Each of the tab portions 30 can have a longitudinal length L less than the core 20 longitudinal length H. Where two or more tab portions 30 are positioned at a given circumferential position, the aggregate longitudinal length of the tab portions 30 can be less than the core 20 length H. For example, in FIG. 8 the aggregate longitudinal length of the tab portions 30 at a given circumferential location is L1+L2, which is less than the core 20 length H. FIGS. 2–4 show a core 20 with only one tab portion 30 at a given circumferential position. The tab portion 30 in FIGS. 2–4 has an aggregate longitudinal length equal to L.

The aggregate longitudinal length of the tab portions 30 at a given circumferential location can be less than the length H of the core 20, so that there is at least one core side panel 25 longitudinally adjacent a tab portion 30 at the given circumferential location. In FIGS. 2–4 and FIG. 8, each tab portion 30 at a given circumferential location is positioned between longitudinally spaced apart core side panels 25.

Without being limited by theory, core side panels 25 (FIG. 2) provide the two distinct stable tab portion 30 configurations 57 and 59 shown in FIG. 6. The core side panels 25 cause the tab portions 30 to "snap" from the stable unfolded configuration 57 shown in phantom to the illustrated stable configuration 59 wherein the tab portions 30 are deformed radially inward of the surfaces 26 and 28 of the core 20. Stated differently, the core side panels 25 provide a geometric constraint that promotes one of the two stable configurations 57 and 59, rather than a configuration intermediate the two distinct stable configurations 57 and 59. Therefore, once the tab portions 30 are deformed radially inward to reduce core 20 to spindle 100 clearance, the core side panels 25 will resist forces that could cause the tab portions 30 to deform radially outward to the stable configuration 57.

The geometric constraint provided by the core side panels 25 will depend on a number of factors, including but not limited to the core 20 material, the aggregate longitudinal length of the tab portions 30 at a given circumferential location, and the circumferential width W (FIG. 2) of the tab portions 30. For the paper cores 20 described above, the aggregate longitudinal length of the tab portions 30 at a given circumferential location should be between about $\frac{1}{4}$ and $\frac{3}{4}$ of the core 20 longitudinal length H to promote the two stable tab portion configurations 57 and 59.

The available width W for each tab portion 30 decreases as the number of tab portions 30 at a particular circumferential position on the core 20 increases. The width W should not be so large that opposite tab portions 30 interfere with one another when the core 20 is in the generally flattened configuration of FIG. 9 and the tab portions 30 are deformed radially inward of the core 20 surfaces 26 and 28. For a core 20 having two diametrically opposed tab portions 30, the width W of each tab portion 30 can equal approximately $\frac{1}{4}$ of the rounded core 20 outer circumference without causing such interference. Alternatively, by longitudinally staggering diametrically opposed tab portions 30, the tab portion 30 width W can be increased up to about ½ of the rounded core 20 outer circumference without interference between the tab portion 30 and other parts of the core 20.

According to the present invention, the rerounded core 20 is not required to have a cylindrical cross-section. The tab portions 30 can provide reduced core 20 to spindle 100 clearance where the core 20 is rerounded to the generally oblong shape shown in FIG. 7, rather than to a generally cylindrical shape. The tab portions 30 in FIG. 7 reduce the relatively large radial clearance between the core 20 and spindle 100 that would otherwise exist along axis a—a.

Referring back to FIG. 1, the core 20 is selectively scored and cut according to the teachings of the present invention prior to the paper product 14 being wound on the core 20. The roll 12, prior to flattening, can be oriented so that a pair of diametrically opposed tab portions 30 are aligned with flattening axis a—a. Diametrically opposed compressive forces parallel to axis a—a and longitudinally aligned with tab portions 30 can be applied to the roll 12 to deform the tab portions 30 radially inward from core surfaces 26 and 28.

Diametrically opposed compressive forces parallel to axis i—i can then be applied to the roll 12 to compress the roll 12 to the generally flattened configuration shown in FIG. 1. The wrapping 16 can hold the roll 12 in the compressed configuration until the roll 12 is to be used.

Upon removing the wrapping 16, the consumer can apply opposed compressive forces to roll 12 or insert a finger or other object into core 20 to deform the tab portions 30 to extend radially inward of the core surfaces 26 and 28. The consumer can then apply compressive forces along flattening axis a—a to reround the roll 12. In many cases rerounding the roll 12 will result in the tab portions 30 extending radially inward of the core 20 surfaces 26 and 28, so that no additional effort on the part of the consumer is required. For instance, where a pair of substantially diametrically opposed tab portions 30 are aligned with flattening axis a—a, as shown in FIG. 7, the opposed compressive forces applied to reround the roll 12 can also deform the tab portions 30 to extend radially inward of the surfaces 26 and 28.

In a second embodiment shown in FIGS. 10 through 13, the core 20 can include at least one deformable tab portion 130. Each tab portion 130 can have first and second longitudinally spaced apart tab portion ends 142 and 144. Tab portion ends 142 and 144 are longitudinally spaced from the ends 22 and 24 of core 20 by core side panels 25.

Figure 11:
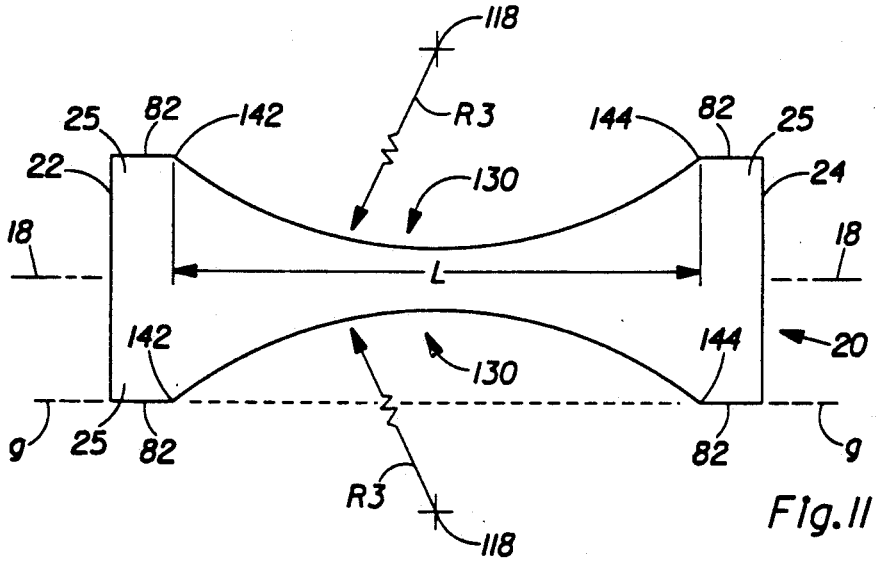
FIG. 11 is a top view of the core of FIG. 10, with the tab portions deformed radially inward when the core is in a generally rerounded configuration.
Figure 12:
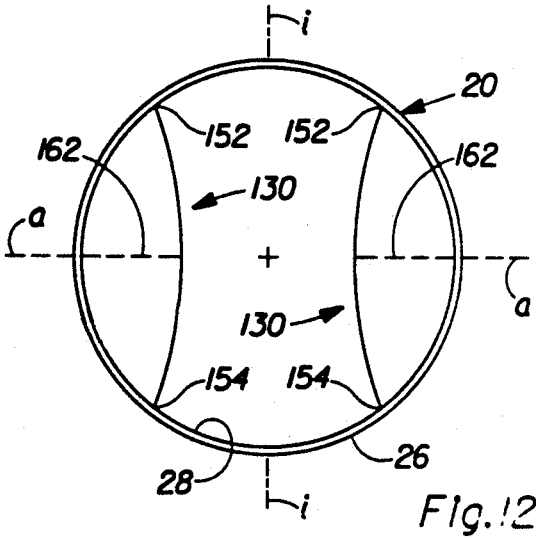
FIG. 12 is an end view of the core of FIG. 10 with the tab portions deformed radially inward when the core is in a generally rerounded oonfiguration.
Figure 13:
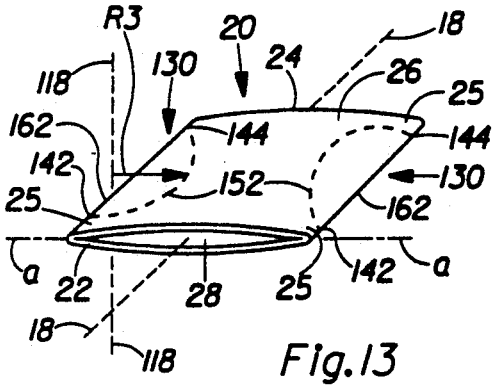
FIG. 13 is a perspective view of the core of FIG. 10 shown in a generally flattened configuration.

Each tab portion 130 can have a first stable configuration wherein the tab portion 130 conforms to the core surfaces 26 and 28, and a second stable configuration wherein the tab portion 130 extends radially inward of the surfaces 26 and 28 of the core 20. FIGS. 11 and 12 show tab portions 130 deformed to the second stable configuration to reduce core to spindle clearance when the core 20 is in a generally rerounded configuration. For this embodiment, "deformed to extend radially inward of the surfaces 26 and 28 of the core 20" indicates the tab portion 130 extends radially inward of an imaginary axis g—g extending between tab portion ends 142 and 144, as shown in FIG. 11. FIG. 13 shows the core 20 in a generally flattened configuration with the tab portions 130 conforming to the surfaces 26 and 28 of the core 20.

As shown in FIG. 11, the tab portion 130 deforms radially inward of the surfaces 26 and 28 of the core 20 to have an axis of curvature 118 which is offset from core axis 18. Axis of curvature 118 is nonparallel to core axis 18. Axis of curvature 118 is preferably substantially perpendicular to core axis 18, as shown in FIGS. 11 and 13. Tab portion 130 can deform radially inward to have a radius of curvature R3, as shown in FIG. 11.

Referring back to FIG. 10, the tab portions 130 are formed by selectively weakening the core 20 with any one of, or a combination of perforations, creases, or score lines. Each tab portion 130 can have first and second longitudinally and circumferentially extending panels 132 and 134 pivotably connected by a folding hinge 162. Each folding hinge 162 can comprise a line of perforations, a crease line, or a score line.

Figure 10:
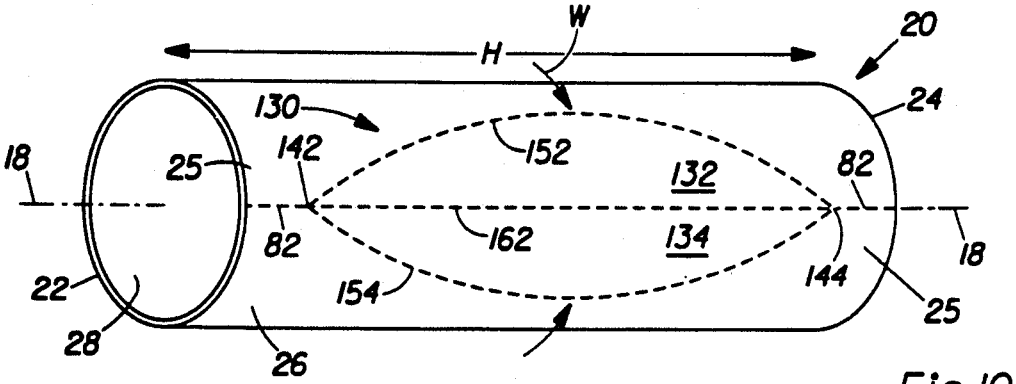
FIG. 10 is a perspective view of a core according to a second embodiment of the claimed invention wherein the tab portions include biconvex selectively weakened panel attachments to the core which intersect at tab portion ends spaced from the core ends.

Panel 132 can be joined to the core 20 by a first curvilinear selectively weakened panel attachment 152 extending between the first and second tab portion ends 142 and 144. Panel 134 can be joined to the core 20 by a second curvilinear selectively weakened panel attachment 154 extending between the first and second tab portion ends 142 and 144. At least a portion of the second curvilinear selectively weakened panel attachment 154 is spaced circumferentially from the first curvilinear selectively weakened panel attachment 152. Panel attachments 152 and 154 can be biconvex. Panel attachments 152 and 154 can intersect at tab portion ends 142 and 144, as shown in FIG. 10, so that the tab portion 130 is circumferentially adjacent core side panels 25. The folding hinge 162 can extend intermediate the tab portion ends 142 and 144. Alternatively, the panel attachments 152 and 154 and folding hinge 62 can extend the full length H of the core 20.

The panel attachments 152 and 154 can comprise a number of arcuate shapes when the core 20 is flattened, as shown in FIG. 13. Such shapes include, but are not limited to, circular arcs, arcs of ovals, or arcs of ellipses. The panel attachments 152 and 154 can comprise a curvilinear line of perforations, a curvilinear crease, or a curvilinear score line. Each panel attachment 152 and 154 can comprise a curvilinear line having multiple radii of curvature.

The core 20 can include a pair of substantially diametrically opposed tab portions 130 having folding hinges 162 circumferentially aligned with a flattening axis a—a, as shown in FIG. 12. If the panel attachments 152 and 154 do not extend the full length of the core 20, core weakening means 82 can be circumferentially aligned with each folding hinge 162 to facilitate flattening of the core 20 along flattening axis a—a, as shown in FIG. 13. The core weakening means 82 can comprise a line of perforations, a crease, or a score line.

Without being limited by theory, it is believed that the bistability of the tab portions 130 is affected by a number of factors, including but not limited to the stiffness of the material of the core 20, the longitudinal length L of the tab portion 130, and the circumferential width W (FIG. 10) of the tab portion 130. Length L should be greater than width W. Where core 20 has a paper construction as described above, the length L is preferably at least ⅔ the length H of core 20. Width W is preferably between about 0.25 and 0.4 times the circumference of core outer surface 26, inclusive.

While particular embodiments of the invention have been illustrated and described, various changes and modifications can be made to the present invention without departing from the spirit and scope of the present invention. The appended claims are intended to cover all such changes and modifications.

What is claimed is:

1. A hollow core about which a paper product may be wound, the core adapted to be supported on a spindle for dispensing of the paper product, and the core being deformable from a generally rounded configuration to a generally flattened configuration, the core comprising:
- an inner surface and an outer surface separated by a core wall having a finite thickness;
- first and second longitudinally spaced apart core ends defining a longitudinal core axis and a core length;
- at least one tab portion deformable to extend radially inwardly of the core surfaces when the core is in the generally rounded configuration, each tab portion comprising:
  - at least one longitudinally and circumferentially extending panel; and
- a selectively weakened panel attachment to the core.

2. A hollow core about which a paper product may be wound, the core adapted to be supported on a spindle for dispensing of the paper product, and the core being deformable from a generally rounded configuration to a generally flattened configuration, the core comprising:
- an inner surface and an outer surface separated by a core wall having a finite thickness;
- first and second longitudinally spaced apart core ends defining a longitudinal core axis and a core length;
- at least one tab portion deformable to extend radially inwardly of the core surfaces when the core is in the generally rounded configuration, each tab portion comprising:
  - at least one longitudinally and circumferentially extending panel;
  - a first curvilinear selectively weakened panel attachment to the core; and
  - a second curvilinear selectively weakened panel attachment to the core, at least a portion of the second curvilinear selectively weakened panel attachment spaced circumferentially from the first curvilinear selectively weakened panel attachment.

3. A hollow core about which a paper product may be wound, the core adapted to be supported on a spindle for dispensing of the paper product, and the core being deformable from a generally rounded configuration to a generally flattened configuration, the core comprising:
- an inner surface and an outer surface separated by a core wall having a finite thickness;
- first and second longitudinally spaced apart core ends defining a longitudinal core axis and a core length;
- at least one tab portion deformable to extend radially inward of the core surfaces when the core is in the generally rounded configuration, each tab portion comprising:
  - at least one longitudinally and circumferentially extending panel; longitudinally spaced apart and circumferentially extending first and second tab portion free edges; and
  - first and second longitudinally extending selectively weakened panel attachments to the core, the first and second selectively weakened panel attachments to the core extending intermediate the first and second free edges.

4. The core recited in claims 2 or 3 comprising a plurality of tab portions symmetrically disposed about a core circumference.

5. The core recited in claim 2 or 3 comprising two substantially diametrically opposed tab portions.

6. The core recited in claim 3 wherein at least one of the first and second tab portion free edges is formed by a circumferentially oriented cut extending through the core wall thickness.

7. The core recited in claim 2 or 3 wherein each tab portion further comprises a folding hinge intermediate the first and second selectively weakened panel attachments to the core.

8. The core recited in claims 2 or 3 wherein each tab portion comprises a first panel pivotably connected to a second panel at a folding hinge intermediate the first and second selectively weakened panel attachments.

9. The core recited in claim 2 wherein each tab portion deforms radially inward to have an axis of curvature which is not parallel to the core axis.

10. The core recited in claim 9 wherein the axis of curvature is substantially perpendicular to the core axis.

11. The core recited in claim 10 wherein the first and second curvilinear selectively weakened panel attachments are biconvex, and wherein the first curvilinear selectively weakened panel attachment intersects the second curvilinear selectively weakened panel attachment at first and second tab portion ends.

12. The core recited in claim 10 wherein the first and second curvilinear selectively weakened panel attachments comprise circular arcs when the core is in the generally flattened configuration.

13. The core recited in claim 10 wherein the tab portion has a longitudinal length L and a circumferential width W, and wherein the longitudinal length L is greater than the circumferential width W.

14. The core recited in claim 13 wherein the longitudinal length L is at least $\frac{2}{3}$ times the core longitudinal length, and wherein the circumferential width W is between 0.25 and 0.4 times the outer circumference of the core.

15. The core recited in claims 2 or 3 wherein the core has a longitudinal Taber Stiffness of at least 40 Taber Stiffness Units (gram-centimeters).

16. The core recited in claims 2 or 3 wherein the core has a longitudinal Taber stiffness of at least 75 Taber Stiffness Units (gram-centimeters).

* * * * *